US006588481B1

(12) United States Patent
Hsu

(10) Patent No.: US 6,588,481 B1
(45) Date of Patent: Jul. 8, 2003

(54) FIXING MOUNT FOR AN UPPER BEAM OF VENETIAN BLIND

(75) Inventor: Pey-Son Hsu, Changhua Hsien (TW)

(73) Assignee: Ching Feng Blinds Ind., Ltd., Changhua Hsien (TW)

( * ) Notice: Subject to any disclaimer, the term of this patent is extended or adjusted under 35 U.S.C. 154(b) by 0 days.

(21) Appl. No.: 10/047,087

(22) Filed: Jan. 17, 2002

(51) Int. Cl.[7] ..... E06B 9/32
(52) U.S. Cl. ..... 160/173 R; 160/177 R
(58) Field of Search ..... 160/177 R, 173 R, 160/176.1 R, 178.1 R, 168.1 R

(56) References Cited

U.S. PATENT DOCUMENTS 2,840,157 A * 6/1958 Lorentzen
4,457,351 A * 7/1984 Anderson
4,676,292 A * 6/1987 Valle et al.
4,697,629 A * 10/1987 Anderson

FOREIGN PATENT DOCUMENTS

GB 1032124 * 6/1966
NL 300512 * 9/1965

* cited by examiner

*Primary Examiner*—Blair M. Johnson
(74) *Attorney, Agent, or Firm*—Troxell Law Office PLLC

(57) ABSTRACT

A fixing mount for use on an upper beam of a Venetian blind is made up of a fixing seat, an adjusting roller and a roller. The fixing seat has a base board and a pair of vertically raised parallel walls which are obliquely extended with respect to the axial direction of the upper beam A of a blind. The ends of the parallel walls are located in fit abutment against the interior surfaces of the upper beam A. The two opposite longitudinal sides of the base board are also located slantly with respect to the axial direction of the upper beam A just as the two parallel walls, defining an angle less than 90 degrees to house an adjusting unit C. Thereby the adjusting unit C can be placed as close as to the fixing seat so as to make the distance between the end of the upper beam A and the adjusting unit C longer adapted for a wide range of window bracket.

1 Claim, 3 Drawing Sheets

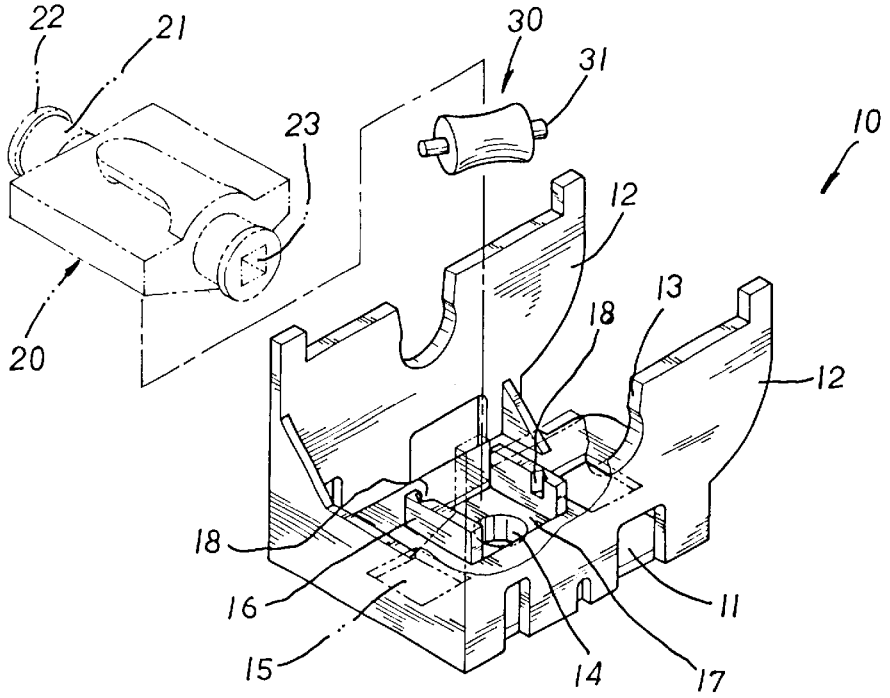
PRIOR ART FIG. 1
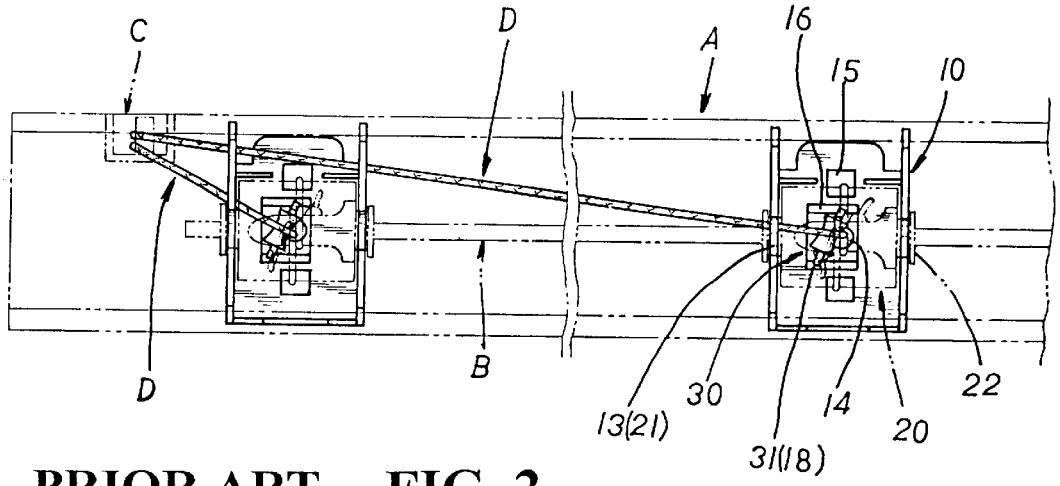
PRIOR ART FIG. 2

FIXING MOUNT FOR AN UPPER BEAM OF VENETIAN BLIND

BACKGROUND OF THE INVENTION

The present invention relates to a fixing mount for use on an upper beam of a Venetian blind. It is made up of a fixing seat, an adjusting roller and a roller. The fixing seat has a base board and a pair of vertically raised parallel walls which are obliquely extended with respect to the axial direction of the upper beam of a blind. The ends of the parallel walls are located in fit abutment against the interior surfaces of the upper beam. The two opposite longitudinal sides of the base board are also located slantly with respect to the axial direction of the upper beam just as the two parallel walls, defining an angle less than 90 degrees to house an adjusting unit. Thereby the adjusting unit can be placed as close as to the fixing seat so as to make the distance between the end of the upper beam and the adjusting unit longer adapted for a wide range of window bracket.

Referring to FIG. 1, a prior art fixing mount of an upper beam is mainly made up of a fixing seat 10, an adjusting wheel 20 and a roller 30. The fixing seat 10 has a bottom board 11 which is axially equipped with a pair of symmetric vertical side plates 12. On the top edge of each vertical side plate 12 is disposed a downwardly extended cut 13. At the center of the bottom board 11 is disposed a round hole 14 next to each side of which is disposed a square through hole 15. Between the round hole 14 and each square through hole 15 is placed a lateral vertical wall 16 with a receiving space 17 defined between the two lateral vertical walls 16. On each lateral vertical wall 16 is disposed an obliquely oriented cavity 18 (off the longitudinal center line of the bottom board 11).

The adjusting wheel 20 has a projected shaft end 21 which is provided with a flanged periphery 22 at each axial end and has a square hole 23 extending through the central line thereof The roller 30 has a longitudinal retaining rod 31 at each end. In assembly, the retaining rods 31 of the roller 30 are registered with the obliquely oriented cavities 18 of the two lateral vertical walls 16 with the roller 30 housed in the receiving space 17 between the vertical walls 16. The projected shaft ends 21 of the adjusting wheel 20 are placed in the downwardly extended cuts 13 of the two vertical side plates 12 with the flanged periphery 22 exposed externally of the vertical side plates 12 for limiting purpose.

Referring further to FIG. 2, when mounted to an upper beam A, a number of fixing seats 10 are slightly guided into the upper beam A and retained in position. The square holes 23 of the rollers 20 rotatably mounted to the fixing seats 10 are engaged with a stick B of a square cross section for synchronous operation. The pull cord D of the blind slats is led upwardly through the bottom holes of the upper beam A and is secured to the rollers 20 respectively. The pull cord D of the blind slats is further guided through the bottom hole of the upper beam and via the round holes 14 of the fixing seat 10 and then wound around the roller 30 of the fixing seat 10 and finally led through the adjusting means c to complete the assembly.

There are several disadvantages associated with such a prior art fixing mount:

1. As the upper beam A is too long and must be cut to fit to a window frame, the distance between the adjusting means C and the nearest fixing seat 10 is relatively too wide, resulting in the cutting length limited to a certain small range.

2. The adjusting means C is disposed relatively far from the fixing seats 10, rendering the pull cord D extending between the adjusting means C and the nearest and farthest fixing seats 10 relatively too long. Thus, a user must exert more force on the pull cord D too pull the blind slats up.

SUMMARY OF THE INVENTION

The primary object of the present invention is to provide an improved fixing mount adapted for use in the upper beam of a blind for guiding a pull cord thereof. The fixing mount assembly obliquely secured with respect to the longitudinal direction of the upper beam of the blind permits the upper beam to be selectively cut to fit to a wide variety of window brackets.

Another object of the present invention is to provide an improved fixing mount which can be secured to the interior of the upper beam at two spaced positions with the pull cord extend with a shorter span, resulting in speedy and effortless operation on the pull cord.

BRIEF DESCRIPTION OF THE DRAWINGS

FIG. 1 is a perspective diagram showing the exploded components of a prior fixing mount;

FIG. 2 is a sectional diagram showing the structure and operation mode of the prior art shown in FIG. 1;

DETAILED DESCRIPTION OF THE PREFERRED EMBODIMENT

Figure 3:
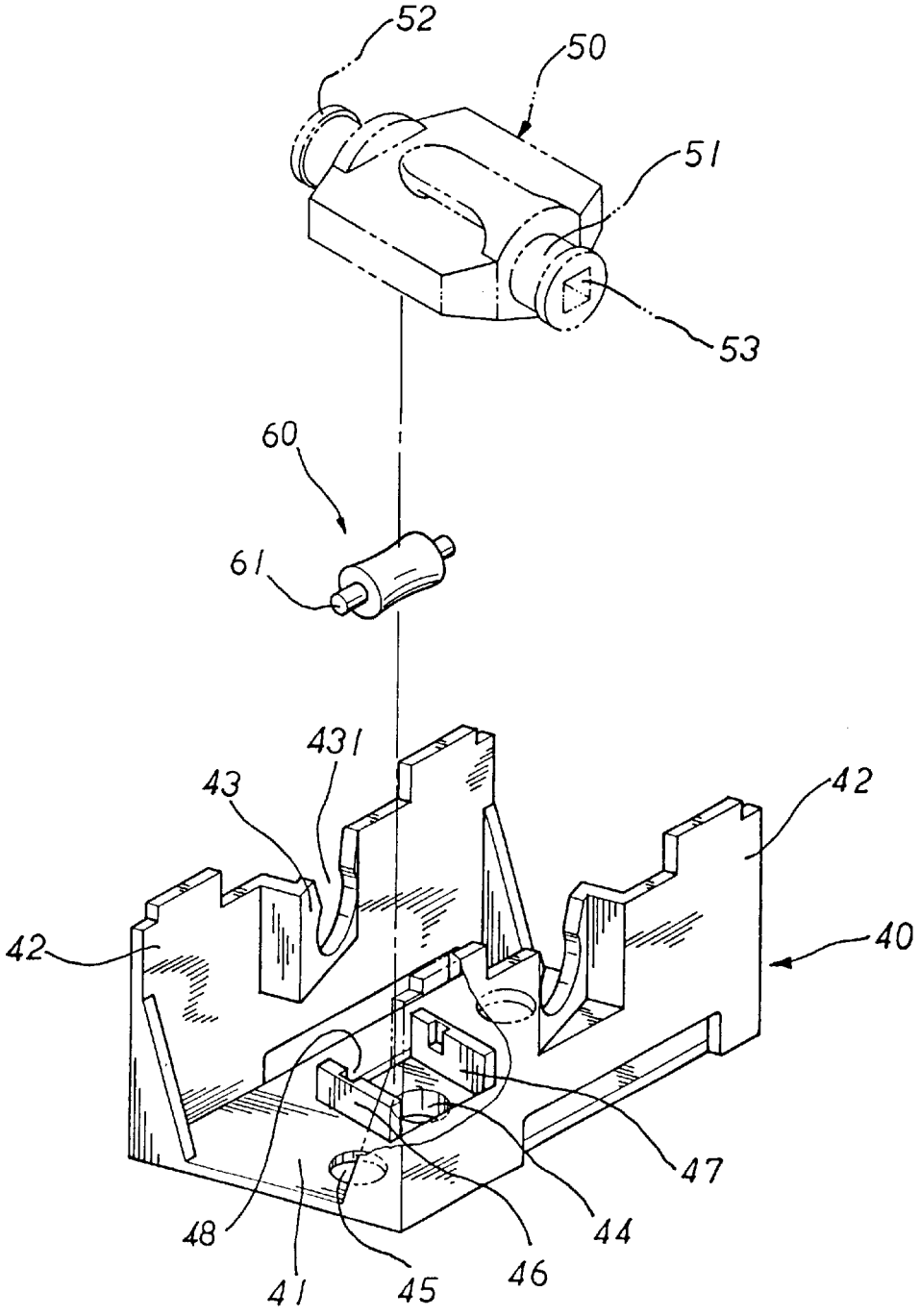
FIG. 3 is a perspective diagram showing the exploded components of the present invention.

Referring to FIG. 3, the fixing mount of the present invention mainly includes a fixing seat 40, an adjusting roller 50 and a roller 60. The fixing seat 40 is of a rhomboid shape and is equipped with a base board 41 and a pair of vertically raised parallel walls 42 which are obliquely extended with respect to the axial direction of the upper beam A of a blind. The ends of the parallel walls 42 are located in fit abutment against the interior surfaces of the upper beam A. The two opposite longitudinal sides of the base board 41 are also located slantly with respect to the axial direction of the upper beam A just as the two parallel walls 42, defining an angled corner 40' less than 90 degrees to house an adjusting unit C. Thereby the adjusting unit C can be placed as close as to the fixing seat 40 so as to make the distance between the end of the upper beam A and the adjusting unit C longer adapted for a wide range of window bracket.

Adjacent to the upper edge of each of the parallel walls 42 is disposed a positioning seat 43 which projects from each respective wall 42 with its joint walls in parallel and orthogonal to the longitudinal wall of the upper beam A respectively, and has an open-end round recess 431 extending downwardly from the edge of the wall perpendicular to the side wall of upper beam A. Thereby the round recess 431 of each positioning seat 43 is oriented in the longitudinal direction of the upper beam A, or is positioned in perpendicular to the longitudinal side walls of the upper beam A so as to permit the adjusting roller 50 to be positioned in parallel to the upper beam A in assembly without interference with the interior of the fixing seat 40. On the base board 41 of the fixing seat 40 is disposed a round hole 44 at the center thereof with a through hole 45 located on each side next to the round hole 44. The round hole 44 and the through holes 45 are in alignment with a line perpendicular to the longitudinal side walls of the upper beam A. Between each through hole 45 and the round hole 44 is disposed a support wall 46 perpendicular to the parallel walls 42 of the fixing seat 40. A receiving chamber 47 is defined between the two parallel support walls 46. On the inner side of each support wall 46 is disposed a retaining recess 48. The two retaining recesses 48 face oppositely to each other.

At each end of the adjusting roller 50 is disposed a shaft journal 51 having an enlarged end edge 52. A square hole 53 longitudinally extends through the center of each adjusting roller 50. The roller 60 has a journal extension 61 at each end. In assembly, the journal extensions 61 of the roller 60 are in registration with the retaining recesses 48 on the support walls 46 so as to allow the roller 60 to be housed in the receiving chamber 47 of the fixing seat 40. The journal shafts 51 of the adjusting roller 50 are engaged with the open-end round recesses 431 of the parallel walls 42 of the positioning seat 43 with the enlarged end edges 52 sticking out of the parallel walls 42 for retaining purpose.

Figure 4:
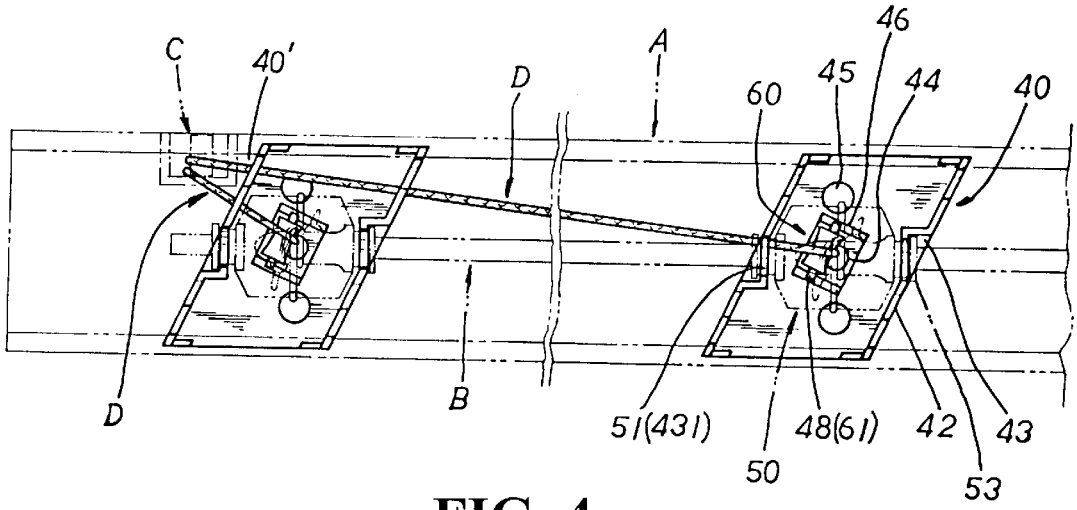
FIG. 4 is a sectional diagram showing the structure and operation mode thereof.

In mounting the fixing mounts onto the upper beam A, as shown in FIG. 4, a number of fixing seats 40 are guided into registration with the upper beam A along the pilot tracks and are secured in place at proper positions and a rod B of a square cross section is led through the square holes 53 of the adjusting rollers 50 of the fixing seats 40 for synchronous operation purpose. The pull cord D is upwardly led through a hole at the bottom of the upper beam A and further via the round hole 44 of the fixing seats 40 and is wound about the rotary rollers 60 of the fixing seats 40. Then the pull cord D is guided through the adjusting unit C to complete the assembly. In operation, the supporting walls 46 on which each rotary roller 60 is mounted permit the pull cord D to be orthogonally pulled back and forth thereon with ease and less effort.

There are a couple of advantages associated with the present invention given as below:

1. The adjusting unit C can be compactly placed at the angled corner 40' defined between the oblique wall 42 of each fixing seat 40 and the side wall of the upper beam A so as to extend the cutting length of the upper beam A in fitting adjustment, permitting the upper beam A to be fit to a wide range of window frame.
2. The length of the pull cord D extending between the nearest and the farthest fixing seats 40 can be effectively shortened so as to permit the pull cord D to be easily actuated with less effort.

I claim:

1. A fixing mount and an upper beam for a Venetian blind, comprising a fixing seat, an adjusting roller and a roller, wherein:

said fixing seat has a rhomboid shape, with a base board and a pair of vertically raised parallel walls which are obliquely oriented with respect to an axial direction of an upper beam, ends of said parallel walls located in fit abutment against interior surfaces of said upper beam; two opposite longitudinal sides of said base board being slanted with respect to the axial direction of said upper beam as are the two parallel walls, thereby defining an angled receiving corner to house an adjusting unit;

adjacent to an upper edge of each of the parallel walls is disposed a positioning seat which projects from each respective wall, with joint walls of the positioning seats being in parallel and orthogonal to a longitudinal wall of the upper beam respectively, and an open-end round recess extending downwardly from an edge of each of the joint walls perpendicular to a side wall of the upper beam, the round recess of each positioning seat is oriented in a longitudinal direction of said upper beam, enabling the adjusting roller to be positioned in parallel to the upper beam in assembly without interference with said fixing seat; said base board having a round hole at a center thereof, with a through hole located on each opposite side adjacent to said round hole; said round hole and said through holes in alignment with a line perpendicular to the longitudinal side walls of said upper beam; between each through hole and said round hole is a support wall perpendicular to the parallel walls of said fixing seat, a receiving chamber being defined between said two parallel support walls, on an inner side of each said support wall is a retaining recess, said retaining recesses facing oppositely to each other;

each end of said adjusting roller has a shaft journal with an enlarged end edge, a square hole longitudinally extending through a center of said adjusting roller; said roller has a journal extension at each end such that said journal extensions of the roller are in registration with the retaining recesses on the support walls enabling the roller to be housed in the receiving chamber of the fixing seat; said journal shafts of the adjusting roller are engaged with said open-end round recesses of the parallel walls of said positioning seat with the enlarged end edges sticking out of the parallel walls for retaining purpose; whereby said fixing seat can be placed close to said an adjusting unit so as to make the distance between an end of said upper beam and said adjusting unit longer for adapting to a wide range of window brackets.

* * * * *